US006675729B2

(12) United States Patent
Green

(10) Patent No.: US 6,675,729 B2
(45) Date of Patent: Jan. 13, 2004

(54) MODULAR BLOCK ASSEMBLY FOR TUFTING MACHINE

(75) Inventor: Jerry Green, Signal Mountain, TN (US)

(73) Assignee: Tuftco Corporation, Chattanooga, TN (US)

( * ) Notice: Subject to any disclaimer, the term of this patent is extended or adjusted under 35 U.S.C. 154(b) by 186 days.

(21) Appl. No.: 10/038,219

(22) Filed: Jan. 3, 2002

(65) Prior Publication Data

US 2003/0131771 A1 Jul. 17, 2003

(51) Int. Cl.[7] ..... D05C 15/24
(52) U.S. Cl. ..... 112/80.6
(58) Field of Search ..... 112/80.6, 80.45, 112/80.53

(56) References Cited

U.S. PATENT DOCUMENTS 4,170,949 A * 10/1979 Lund ..... 112/80.45
4,313,388 A * 2/1982 Biggs et al. ..... 112/80.53
4,491,078 A * 1/1985 Ingram ..... 112/80.6
4,608,934 A * 9/1986 Card et al. ..... 112/80.6
4,669,171 A * 6/1987 Card et al. ..... 29/446
4,691,646 A * 9/1987 Card et al. ..... 112/80.6
4,693,191 A * 9/1987 Card et al. ..... 112/80.6
4,817,541 A * 4/1989 Magourik ..... 112/80.6
5,295,450 A * 3/1994 Neely ..... 112/80.45
5,896,821 A * 4/1999 Neely et al. ..... 112/80.52
5,954,003 A * 9/1999 Beyer et al. ..... 112/80.45
6,116,173 A * 9/2000 Beyer ..... 112/80.45
RE37,108 E * 3/2001 Neely ..... 112/80.45

OTHER PUBLICATIONS

RCM System, Cobble Division –Spencer Wright Industries, Joining the benefits of modular construction with unprecedented cutting accuracy.*

* cited by examiner

*Primary Examiner*—Ismael Izaguirre
(74) *Attorney, Agent, or Firm*—Douglas T. Johnson

(57) ABSTRACT

A tufting machine modular gauge assembly that allows damaged or broken gauge elements to be replaced individually. The modular gauge assembly consists of a gauge bar with a plurality of modular blocks removably attached to the bar. The modular blocks are six sided with a detent and fastener mechanism for attaching the block to the gauge bar. The gauge elements may be attached to the block by dedicated screw-pins or by a securing pin that passes through all the gauge elements within a block.

17 Claims, 3 Drawing Sheets

5
10
22a
25
30
35
20
15

5
40
40
25
35
31
30
10
75
22b
55
50
51
65
85
70
45
22a
15
60
20
32
100

165
45
110
90
120
15
115
60

MODULAR BLOCK ASSEMBLY FOR TUFTING MACHINE

FIELD OF THE INVENTION

The present invention relates to a tufting machine with replaceable self-aligning gauge modules and is more particularly concerned with a gauge module with individually replaceable gauge elements which can be readily installed and removed.

BACKGROUND OF THE INVENTION

Tufting machines are built with precision so that the needles and loopers of the machine are accurately spaced from each other along the needle bar or looper bars. The loopers and needles must be spaced from each other so that the looper bills pass closely adjacent to the needles to engage and hold loops of yarns carried by the needles. When assembling a tufting apparatus, errors in positioning these gauge elements may accumulate as the work progresses. The present invention seeks to establish consistency with these parts across the width of the apparatus, to provide a tufting environment, suitable even for narrow gauge configurations. The present invention also addresses the problem of replacing individual gauge elements that become broken or damaged during tufting. In most modular designs, a broken gauge element requires discarding the entire modular block containing a set of about one to two dozen gauge elements. The present invention allows for quick and efficient replacement of individually damaged gauge elements.

The idea of replacing individual components of assemblies in tufting machines is not new. In the past, knife holder assemblies have been devised that allow for the replacement of individual knives. The knives were arranged in pre-assembled or modular fashion in a knife holder, each knife holder having a guide mechanism which enables the knives, as a group, to be positioned on a carrying member of a tufting machine and maintained in appropriate alignment. U.S. Pat. Nos. 4,608,934; 4,669,171; 4,691,646; and 4,693,191 illustrate such prior art knife holder assemblies in which parallel knives are disposed in juxtaposition in guide bars which are provided with guides for guiding and then clamping them in appropriate positions on a tufting machine.

Needles have previously been individually secured in modular gauge blocks as shown in U.S. Pat. No. 4,170,949, and hooks and knives have also been individually secured in gauge parts mounting blocks as shown in U.S. Pat. No. 4,491,078. These designs have used individual clamping screws to hold each gauge element in place. These blocks were not mated with slots on the carrying members and were heavily machined.

More recently attempts have been made to incorporate needles and loopers into replaceable modular assemblies. U.S. Pat. Nos. RE37,108, 5,896,821, 5,295,450 illustrate such modular gauge assemblies in which the gauge elements are permanently embedded into the modular block. The block is attached to the guide bar with a single screw allowing for removal and replacement of the block. One shortcoming of these modular assemblies is that when a single gauge element breaks the entire modular assembly must be discarded.

SUMMARY OF THE INVENTION

The present invention includes a modular gauge assembly that attaches to a gauge bar. The gauge bar has a plurality of positioning recesses that allows a detent on an individual modular block to be accurately positioned along the gauge bar. Each modular block typically includes a front surface, a pair of side surfaces opposed to each other, a rear surface opposite to the front surface, and a bottom surface. A tongue, which may or may not be a part of the cast block extends from a bottom or bottom surface of the modular block. The tongue includes a threaded hole which along with a securing screw serves to mount the block to a gauge bar. The threaded hole aligns with the gauge bar receiving hole when the tongue of the modular block is positioned properly with a recess on the gauge bar. When sufficiently tightened, the securing screw holds the modular block to the gauge bar. At least the front surface contains a plurality of spaced parallel slots so that gauge elements may be positioned in the slots with proper spacing in the block. The proximal ends of the gauge elements have apertures recessed therein. The proximal ends of the gauge elements are inserted into the block and secured there by a securing pin that enters the block on one of the opposing side surfaces and passes through the apertures on the proximal ends of the gauge elements. Individual gauge elements can be replaced by demounting the affected block, removing the securing pin and removing the selected gauge element. After the selected gauge element is removed a new gauge element may be re-inserted into the proper vertical slot and secured by the securing pin.

A plurality of modular blocks are arranged along the surface of the gauge bar and are vertically positioned on the gauge bar by a horizontal surface on the gauge bar or on a guide bar that passes through a guide bar channel on the gauge bar. The width of each block is equal to the distance between the positioning recesses of the gauge bar so that the edges of the blocks abut one another and the blocks are laterally positioned.

In an alternative embodiment of the present invention the modular gauge assembly attaches to a gauge bar having a plurality of positioning recesses that allows the detent on an individual modular block to laterally position the block on the gauge bar. Each modular block typically includes a front surface, a pair of side surfaces opposed to each other, a rear surface opposite to the front surface, and opposing bottom and top surfaces. The rear surface contains a rectangular tab or detent that includes a threaded hole to receive a securing screw. The threaded hole aligns with the gauge bar receiving hole when the modular block is positioned properly on the gauge bar. When tightened, the securing screw holds the modular block securely to the gauge bar. A plurality of gauge holes extend from the bottom toward the top surface, in some cases passing through the modular block. Gauge elements with proximal ends adopted to be received within the gauge holes may be positioned with proper spacing in the block. Gauge elements that have the proximal end inserted into the block are securely positioned pin-screws that enter the block below the tab on the rear surface. The pin-screws are positioned beneath the tab. In this fashion, the pin-screws can be accessed without removing the modular block from the gauge bar.

Accordingly, it is an object of the present invention to provide a tufting machine where the gauge elements of the tufting machine are accurately positioned within a modular block assembly.

Another object of the present invention is to provide in a tufting machine, a system which can facilitate the rapid change over of one or more damaged gauge elements, reducing to a minimum the downtime of the tufting machine.

Another object of the present invention is to provide in a modular block assembly, a system which can facilitate the rapid change over of individual damaged gauge elements, reducing the cost of repairing broken gauge elements and removing the need to replace entire modular blocks when a single gauge element becomes damaged.

Other objects, features, and advantages of the present invention will become apparent from the following description when considered in conjunction with the accompanying drawing wherein like characters of reference designate corresponding parts throughout several views.

DETAILED DESCRIPTION

The present invention is utilized in a tufting machine of the type generally including a needle bar carrying one or more rows of longitudinally spaced needles and which is supported and reciprocally driven by a plurality of push rods. In the tufting zone, the needles carry yarns which are driven through a backing fabric by the reciprocation of the needles. While penetrating the backing fabric, a plurality of longitudinally spaced hooks cooperate with the needles to seize loops of yarns and thereby form the face of a resulting fabric. In some cases the hooks will cooperate with knives to cut the loops of yarn seized on the hooks and thereby form a cut pile face for the fabric. The present invention is directed to modular units for holding loopers or hooks and for holding needles to facilitate their cooperation during the tufting process.

Figures 1, 2, 3:
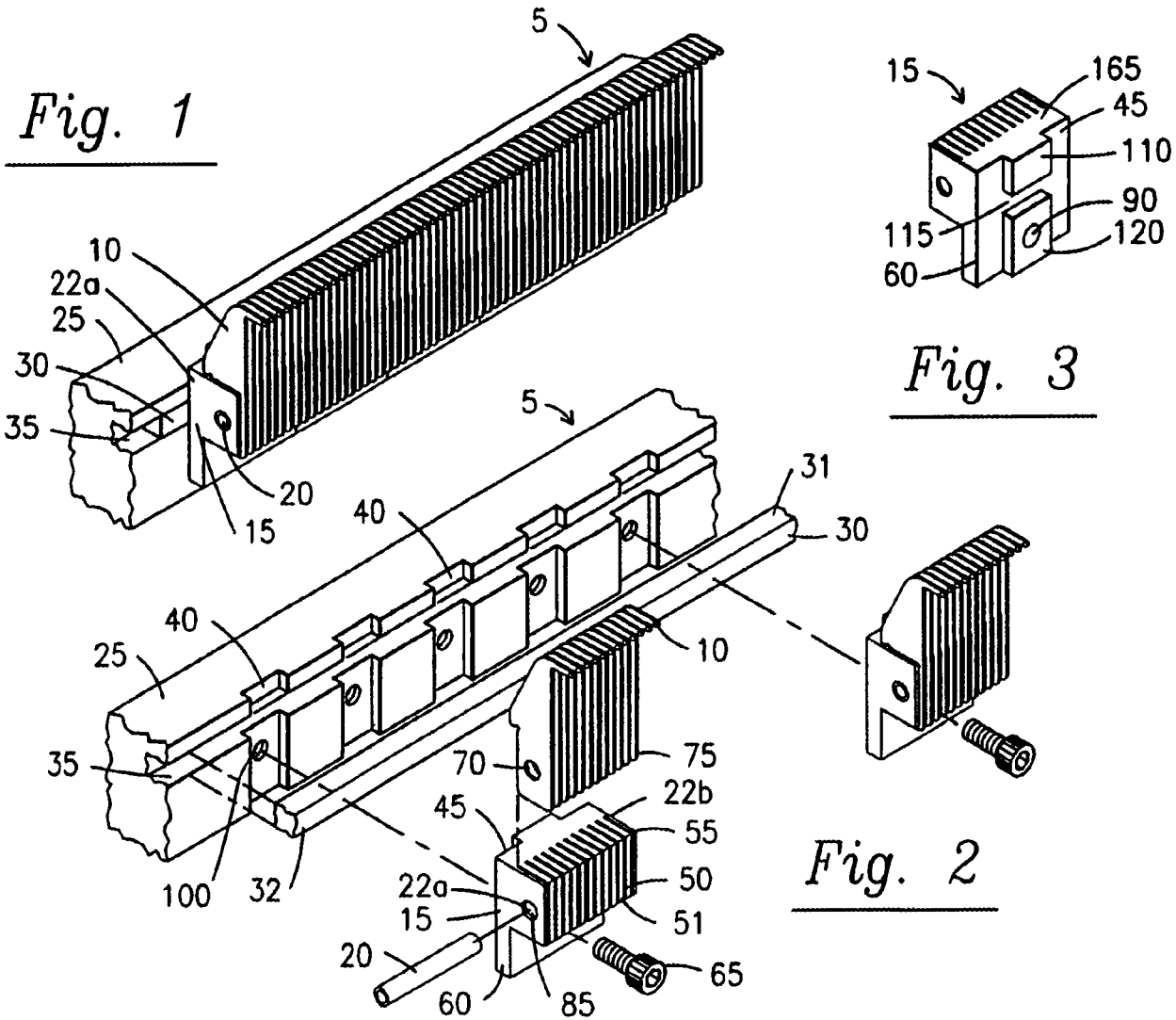
FIG. 1 is a fragmentary perspective view of a modular block assembly with single looper modular blocks in place on a gauge bar.
FIG. 2 is an exploded perspective view of modular block assembly of FIG. 1 with modular blocks removed from the gauge bar, and one single looper modular block disassembled.
FIG. 3 is a perspective view of the rear surface of a modular block of FIG. 1.

Referring in detail to FIG. 1, a modular block assembly 5 is illustrated having a single row of gauge elements 10, in this case loopers, housed in the modular blocks 15. The individual gauge elements 10 are fastened to the block 15 by securing pin 20. As better illustrated in FIG. 2, the securing pin 20 enters the modular block 15 at one of the opposing side surfaces 22*a,* 22*b*. The gauge bar 25 and guide bar 30 are used in concert to position the individual modular blocks 15 relative to one another. The guide bar 30 slides laterally through channel 35 substantially the entire length of the gauge bar 25, and engages tab breaks 115 of the modular blocks 15, as shown in FIG. 3, to vertically align the individual blocks 15.

FIG. 2 illustrates a portion of the modular block assembly 5 with the blocks 15 detached from the gauge bar 25. The gauge bar 25 has a plurality of vertical recesses 40. The recesses 40 are crossed by lateral channel 35 so that guide bar 30 fits between the gauge bar 25 and the rear surfaces 45 of the modular blocks 15. Guide bar 30 creates upper face 31 and lower face 32 which are normal to the side walls of recesses 40. Theses faces 31, 32 serve as restraining surfaces. One modular block 15 in FIG. 2 is disassembled and removed from the gauge bar 25 to reveal the spaced parallel slots 50 divided by vertical walls 51 located on the front surface 55 of the block for receiving the proximal ends 75 of the gauge element 10. The proximal ends 75 of the gauge elements 10 contain apertures such as pin holes 70. When the gauge elements 10 are positioned in the modular block 15, the pinholes 70 align with apertures formed in side surfaces of the block such as pin opening 85. Securing pin 20 is then inserted through the pin opening 85 in one of the opposing side surfaces 22*a,* 22*b,* and the pin opening 85 for each gauge element 10 to fasten the gauge elements 10 to the block 15. In modular blocks 15 containing only a single row of gauge elements 10, a tongue portion 60 extends from the rear surface 45 of the modular block 15. The tongue 60 forms the detent. The tongue 60 has an opening 90, as shown in FIG. 3, preferably in the form of a threaded hole which aligns with another hole 100, located in a gauge bar recess 40, when the modular block 15 is positioned on the gauge bar 25. Once a modular block 15 is positioned a securing screw 65 can be inserted through the opening 90 and tightened into the hole 100 on the gauge bar. A modular block 15, once fixed in place by the securing screw 65, is prevented from lateral and vertical movement. The screw 65 and vertical recesses 40 resist against horizontal movement while the screw and faces 31,32 of the guide bar 25 resist against vertical movement. The fixed position of the blocks 15 insures that the gauge elements 10 remain properly aligned during the tufting process.

FIG. 3 shows the rear surface 45 of a modular block 15 having a single row of gauge elements 10. On the rear surface 45 is an elongated tab 110 that extends vertically from the top 165 of the block to the bottom of the tongue portion 60 of the block. The tab 110 has a horizontal break 115 which as previously described engages with guide bar 30 to vertically position block 15 on the gauge bar 25. The walls of break 115 are preferably substantially planar and parallel so that a part of the rectangular cross section of guide bar 30 closely fits within the break. The lower segment of the tab 120 contains the opening 90 where the securing screw 65 enters and attaches to a receiving hole 100 in the gauge bar.

Figure 4:
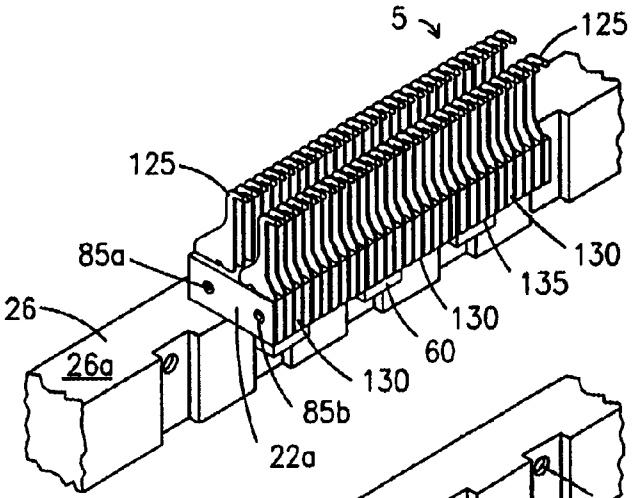
FIG. 4 is a fragmentary perspective view of a double looper modular block assembly with the modular blocks in place or the gauge bar.

FIG. 4 illustrates a modular block assembly 5 having three double gauge element modular blocks 130 mounted on the gauge bar 26. Each modular block 130 contains two gauge element rows 125. Modular blocks 130 have two apertures such as pin openings 85*a,* 85*b* that are spaced apart on the side surfaces 22*a,* 22*b* of the block 130. Unlike single gauge element blocks 15, a portion of the double gauge modular blocks 130 rests on top of the gauge bar 26 to vertically position blocks 130. This is accomplished by pushing the tongue 60 forward to the center of the bottom of the block 135.

Figure 5:
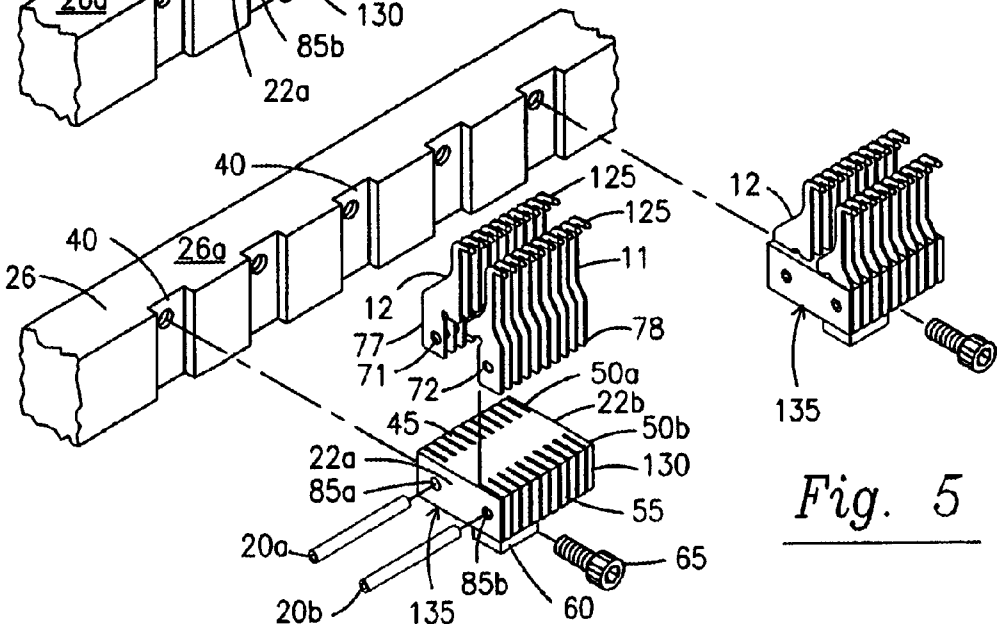
FIG. 5 is an exploded perspective view of the modular block assembly of FIG. 4, with modular blocks removed from the gauge bar and one block disassembled.

FIG. 5 shows an exploded view of modular block 130 containing two rows 125 of gauge elements 11, 12. The gauge bar 26 in FIG. 5 has a plurality of vertical recesses 40. Vertical recesses 40 receive tongues 60 to horizontally position blocks 130 along the gauge bar 25. Vertical positioning is accomplished by resting part of the bottom surface of gauge blocks 130 on the top surface of gauge bar 25. The modular block 130 in FIG. 5 is disassembled and removed from the gauge bar 26 to reveal the spaced parallel slots 50*a*, 50*b* located on the front 55 and rear surface 45 of the block 130 for receiving the proximal ends 75, 78 of the gauge elements 11, 12. The proximal ends 77, 78 of the gauge elements 11, 12 contain openings such as pin holes 71, 72 which when positioned in slots 50*a*, 50*b* of modular block 130 align with pin openings 85*a* or 85*b*, respectively. The securing pins 20*a*, 20*b* are inserted through the pin openings 85*a* or 85*b* on one of the opposing side surfaces 22*a*, 22*b* and through pin holes 71, 72 for each gauge element 11, 12 to fasten the gauge elements 11, 12 to the modular block 130. In the illustrated modular blocks 130 containing two rows 125 of gauge elements 11, 12 the tongue portion 60 of the modular block 130 extends from the center of the bottom surface 135. The tongue 60 defines an opening 90 (not shown) which aligns with receiving holes 100, located in the vertical recesses 40, when the modular block 130 is positioned on the gauge bar 26. Once the modular block 130 is positioned a securing screw 65 can be inserted through opening 90 and tightened into a threaded receiving hole 100. The modular block 130, once fixed in place by the securing screw 65, is prevented from lateral and vertical movement. The fixed position of the block 130 insures that the gauge elements 10 remain properly aligned during the tufting process.

Figures 6, 7, 8:
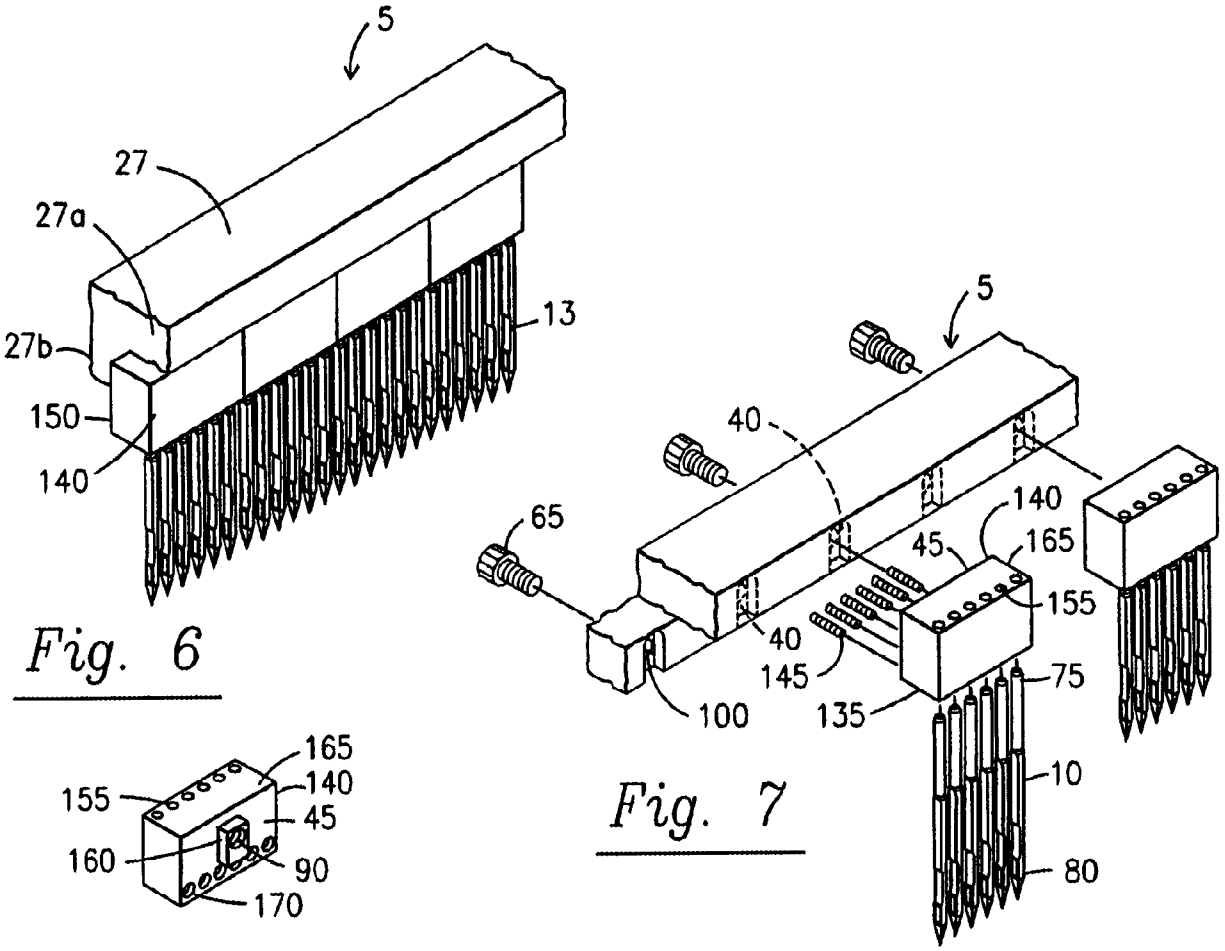
FIG. 6 is a fragmentary perspective view of a modular needle block assembly with the modular blocks in place on a gauge bar.
FIG. 7 is an exploded fragmentary perspective view of the modular needle block assembly of FIG. 6 with the modular blocks removed from the gauge bar and one block disassembled.
FIG. 8 is a rear perspective view of a modular block of FIG. 6.

Referring now to FIG. 6, another aspect of the present invention depicts a modular block assembly 5 having a single row of gauge elements, in this case needles 13, housed in a clamping modular block 140. FIG. 6 shows four clamping modular blocks 140 attached to the gauge bar 27. The clamping modular blocks 140 are positioned such that the lower portion 150 of the block 140 extends beneath the gauge bar 27. This exposed lower portion 150 contains the individual clamping elements, such as screw-pins 145, shown in FIG. 7, that hold the gauge elements 13 in place in the block 140. The gauge bar 127 has a horizontal shelf portion 27*a* and a vertical portion 27*b* which join to form an interior right angle.

FIG. 7 illustrates a portion of a modular block assembly 5 with screw-pin modular blocks 140 detached from the gauge bar 25 and one block 140 disassembled. The gauge bar 27 has a plurality of vertical recesses 40 imposed on the front of the gauge bar 27. As illustrated, the recesses 40 do not extend the entire height of the wall portion 27*b* of the gauge bar 27. Each recess contains a preferably threaded hole 100 which receives a securing screw 65 to attach the block 140 to the gauge bar 27. The rear surface of the modular block 45 contains a rectangular tab 160 having an opening 90, shown in FIG. 8, which aligns with the hole 100, located in the gauge bar vertical recesses 40. Once the modular block 140 is positioned in the right angle between the shelf portion 27*a* and wall portion 27*b*, with tab 160 received in a vertical recess 40, the securing screw 65 can be inserted through the corresponding hole 100 in the wall portion 27*b* into the opening 90 in the rectangular tab 160 and tightened to hold the modular block 140 in place. Once fixed in place by securing screw 65, the modular block 140 is prevented from lateral movement by the action of the tab 160 fitting with the walls of the vertical recess 40, the screw 65, and adjacent blocks 140. Horizontal movement is restored by action of the screw 65 at the bottom of shelf portion 27*a* of the gauge bar 27. The fixed position of the block 140 insures that the gauge elements 10 remain properly aligned during the tufting process.

FIG. 7 also depicts a disassembled clamping modular block 140 thereby revealing the spaced parallel gauge element openings 155 which extend from the top surface 165 to the bottom surface 135 of the block 140. Openings 155 need not extend completely to the top surface 165 for satisfactory operation, however, it is convenient for manufacture. The individual needles 13 are fastened to the block 140 by dedicated clamps such as screw-pins 145 that fix individual gauge elements 10 within the block 140. Screw pins 145 enter the block 140 at the rear surface 45 of the block 45 on its lower portion 150. When the block is attached to the gauge bar 25 the screw-pins 145 remain accessible so that individual gauge elements 10 can be removed and replaced.

FIG. 8 illustrates the top 165 and rear surface 45 of the block 140. Gauge element openings 155 can be seen on the top surface 165 of the block 140. The rectangular tab 160 for positioning the block 140 on the gauge bar 25 is located centrally on the rear surface 45 of the block 140. The rectangular tab 160 defines the opening 90 which aligns with the holes 100 in vertical recesses 40 and with securing screw 65 fixes the block 140 to the gauge bar 27. Openings 170 for screw pins 145 are located horizontally along the lower portion 150 of block 140.

Although a preferred embodiment of the present invention has been disclosed in detail herein, it will be understood that various substitutions and modifications may be made to the disclosed embodiment described herein without departing from the scope and spirit of the present invention as recited in the appended claims.

What is claim is:

1. A modular gauge assembly for holding a plurality of modular block assemblies with gauge elements being selectively mountable in a plurality of spaced recesses of a tufting machine gauge bar, the modular block assembly comprising:

(a) a modular block having a front surface, a pair of side surfaces opposed to each other, a rear surface opposite to the front surface, a top surface and a bottom surface;

(b) a detent extending from a surface of the modular block interfitting with a recess in the gauge bar;

(c) a plurality of vertical parallel slots horizontally spaced between the opposing side surfaces of the modular block for receiving gauge elements;

(d) at least one opening extending horizontally between the opposing side surfaces of the modular block;

(e) a securing pin for slidably engaging said at least one opening; and (f) a plurality of gauge elements having a distal end and a proximal end with an opening therein, the proximal ends of said gauge elements being received in the vertical parallel slots of the modular block and the securing pin passing through the openings in the proximal ends of the plurality of gauge elements.

2. The modular gauge assembly of claim 1 wherein the detent comprises a vertically disposed elongated tab separated by a channel into an upper portion and a lower portion.

3. A modular gauge assembly for holding a plurality of modular block assemblies with gauge elements being selectively mountable in a plurality of spaced recesses of a tufting machine gauge bar, the modular block assembly comprising:

(a) a modular block having a front surface, a pair of side surfaces opposed to each other, a rear surface opposite to the front surface, a top surface and a bottom surface;

(b) a detent extending approximately from the center of the bottom surface of the modular block and interfitting with a recess in the gauge bar;

(c) a plurality of vertical parallel slots horizontally spaced between the opposing side surfaces of the modular block for receiving gauge elements;

(d) at least one opening extending horizontally between the opposing side surfaces of the modular block; and (e) a securing pin for slidably engaging said at least one opening.

4. The modular gauge assembly of claim 3 wherein the modular block has a first forward plurality of spaced vertical slots separated by vertical walls with openings therein and a second rearward plurality of spaced vertical slots separated by vertical walls with openings therein.

5. The modular gauge assembly of claim 4 wherein the modular block has a first opening extending between the opposing side surfaces of the modular block and passing through the openings in the vertical walls separating the forward plurality of spaced vertical slots and a second opening extending between the opposing side surfaces of the modular block and passing through the openings in the vertical walls separating the rearward plurality of spaced vertical slots.

6. A modular gauge assembly for holding a plurality of modular block assemblies with gauge elements being selectively mountable in a plurality of spaced recesses of a tufting machine gauge bar, the modular block assembly comprising:

(a) a modular block having a front surface, a pair of side surfaces opposed to each other, a rear surface opposite to the front surface, a top surface and a bottom surface;

(b) a detent extending from a surface of the modular block interfitting with a recess in the gauge bar, wherein a fastener is used to pass through the detent and secure the modular block assembly to the gauge bar;

(c) a plurality of vertical parallel slots horizontally spaced between the opposing side surfaces of the modular block for receiving gauge elements;

(d) at least one opening extending horizontally between the opposing side surfaces of the modular block; and (e) a securing pin for slidably engaging said at least one opening.

7. The modular gauge assembly of claim 5 further comprising a plurality of gauge elements having a distal end and a proximal end with an opening therein, the proximal ends of said gauge elements being received in the vertical parallel slots of the modular block and the securing pin passing through the openings in the proximal ends of the plurality of gauge elements.

8. In a tufting machine a modular gauge assembly comprising:

(a) an elongated gauge bar with a straight side extending along at least a portion of the length of the gauge bar, the straight side portion of the gauge bar having a plurality of spaced recesses defined therein;

(b) a plurality of modular blocks for engaging the straight side of the guide bar, each modular block having a detent which aligns with a recess in the gauge bar and having:

(i) a rear surface;

(ii) spaced parallel tufting machine gauge elements protruding from the modular block, each gauge element having a proximal end and a spaced distal end, the proximal ends of the gauge elements having an opening for fixing a plurality of the gauge elements to the block with a single securing pin;

(iii) a hole in the detent; and (iv) a fastener utilizing the hole in the detent for removably securing each of the modular blocks to the gauge bar.

9. The modular gauge assembly of claim 8 wherein the detent of each mounting block comprises a raised member defined on the rear surface of the modular block, said raised member being interfitting with the spaced recesses in the gauge bar.

10. The modular gauge assembly of claim 9 wherein the raised member is split to accommodate restraining surfaces.

11. A process of producing a tufting machine, the tufting machine having a tufting zone therein, said process comprising the steps of:

(a) forming a plurality of spaced, parallel, straight recesses across one side portion of an elongated gauge bar of the tufting machine;

(b) installing the gauge bar transversely of the tufting machine in the tufting zone;

(c) producing a plurality of modular blocks where each block has opposed parallel side surfaces a bottom surface, a rear surface, and a detent;

(d) forming on the rear surface of each modular block, an elongated tab having approximately the width of one of the recesses on the gauge bar, said tab having a hole therein;

(e) removably attaching gauge elements by their proximal end portions in each of the modular blocks, in parallel relationship to said side surfaces so that distal end portions of the gauge elements protrude from the modular blocks; and (f) adjacently securing the modular blocks on the side portion of the gauge bar by interfitting the tab of each modular block in a recess on the gauge bar and using a fastener associated with the hole on the tab of each modular block.

12. The process of claim 11 including the step of removing a selected modular block having a damaged gauge element and replacing said block with a modular block having only undamaged gauge elements.

13. The process of claim 12 wherein a damaged gauge element is removed from the selected modular block, and replaced with a new gauge element.

14. The process of claim 11 wherein the step of securing the modular blocks to the gauge bar includes the step of resting the bottom portion of the modular block on the guide bar inserting the detent of the modular block in a recess of the gauge bar and passing a fastener through an opening in the detent into a receiving hole in the recess on the gauge bar.

15. In a tufting machine a modular gauge assembly comprising:

(a) an elongated gauge bar with a straight side extending along at least a portion of the length of the gauge bar, the straight side portion of the gauge bar having, a plurality of spaced recesses defined therein, and an opening defined within the recessed portion of the gauge bar;

(b) a plurality of modular blocks for engaging the straight side of the guide bar, each modular block having a detent which aligns with a recess in the gauge bar and having:

(i) a rear surface;

(ii) spaced parallel tufting machine gauge elements protruding from the modular block, the modular block having a row of gauge element openings for receiving the gauge elements in the block;

(iii) screw pin openings corresponding to each gauge element, each of the openings capable of receiving a screw-pin to secure the gauge element to the block;

(iv) a receiving hole on the detent of the receiving block;

(c) a fastener passing through the opening on the gauge bar into the receiving hole on the corresponding modular block for removably securing the modular blocks to the gauge bar.

16. A modular block assembly for use in a tufting machine comprising:

(a) a modular block having a front surface, a pair of opposed side surfaces, a rear surface, a top surface and a bottom surface;

(b) a detent extending from a surface of the modular block and having an opening therein;

(c) a plurality of vertical parallel slots separated by vertical walls having openings therein, and spaced between the opposing side surfaces of the modular block;

(d) a plurality of gauge elements having a distal end and a proximal end with an opening therein, the proximal ends of said gauge elements being received in the vertical parallel slots of the modular block;

(e) an opening extending laterally between the opposing side surfaces of the modular block;

(f) a securing pin extending through the lateral opening in the opposing sided surfaces, the opening in the proximal ends of the gauge elements, and the openings in the vertical walls.

17. The modular gauge assembly of claim 16 wherein the detent of each mounting block comprises a raised member defined on the rear surface of the modular block, said raised member being sized and shaped to be received within one of the spaced recesses in the gauge bar.

* * * * *